US012546179B2

(12) United States Patent
Dhamodaran et al.

(10) Patent No.: US 12,546,179 B2
(45) Date of Patent: Feb. 10, 2026

(54) INTERACTIVE MONITORING AND CONTROL SYSTEM FOR A MINERAL EXTRACTION SYSTEM

(71) Applicant: Schlumberger Technology Corporation, Sugar Land, TX (US)

(72) Inventors: Dinesh Kumar Dhamodaran, Coimbatore (IN); Dhinesh Prabhu Nataraja Prabu, Coimbatore (IN); Matthew Olson, Cypress, TX (US); Vikas Rakhunde, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 362 days.

(21) Appl. No.: 18/253,618

(22) PCT Filed: Nov. 16, 2021

(86) PCT No.: PCT/US2021/072438

§ 371 (c)(1),
(2) Date: May 19, 2023

(87) PCT Pub. No.: WO2022/109548

PCT Pub. Date: May 27, 2022

(65) Prior Publication Data

US 2024/0003214 A1 Jan. 4, 2024

Related U.S. Application Data

(60) Provisional application No. 63/198,875, filed on Nov. 19, 2020.

(51) Int. Cl.
*E21B 43/00* (2006.01)
*E21B 21/08* (2006.01)
(Continued)

(52) U.S. Cl.
CPC ..... *E21B 33/06* (2013.01); *E21B 47/00* (2013.01)

(58) Field of Classification Search
CPC ..... E21B 33/06; E21B 47/00; E21B 43/00; E21B 41/00; E21B 44/00; E21B 21/08
See application file for complete search history.

(56) References Cited

U.S. PATENT DOCUMENTS 2,028,046 A 1/1936 Edison
5,331,318 A 7/1994 Montgomery
(Continued)

FOREIGN PATENT DOCUMENTS

CN 102425390 A 4/2012
CN 110709579 A 1/2020
(Continued)

OTHER PUBLICATIONS

Cameron, "Marinor Stena SHI Hull 1669 Drill Max 2—Subsea Multiplex BOP Control System: Operation and Maintenance Manual", International Corporation, 146 pages, 2010.
(Continued)

*Primary Examiner* — Thomas C Lee
*Assistant Examiner* — Michael V Farina
(74) *Attorney, Agent, or Firm* — Kyle R. Miiller

(57) ABSTRACT

An interactive monitoring and control system for a mineral extraction system includes one or more processors configured to receive sensor data indicative of properties of components of the mineral extraction system and to provide a user interface for display via a display screen. The user interface includes a representation of the components of the mineral extraction system, includes the sensor data indicative of the properties of the components of the mineral extraction system, and enables a user to provide inputs to adjust the components of the mineral extraction system.

9 Claims, 14 Drawing Sheets

(51) Int. Cl.

| | |
|---|---|
| ***E21B 33/06*** | (2006.01) |
| ***E21B 41/00*** | (2006.01) |
| ***E21B 44/00*** | (2006.01) |
| *E21B 47/00* | (2012.01) |

(56) References Cited

U.S. PATENT DOCUMENTS 5,597,042 A 1/1997 Tubel
5,662,165 A 9/1997 Tubel
5,706,892 A 1/1998 Aeschbacher, Jr.
5,706,896 A 1/1998 Tubel
5,730,219 A 3/1998 Tubel
5,732,776 A 3/1998 Tubel
5,934,371 A 8/1999 Bussear
5,959,547 A 9/1999 Tubel et al.
5,992,250 A 11/1999 Kluth
6,006,832 A 12/1999 Tubel
6,012,015 A 1/2000 Tubel
6,046,685 A 4/2000 Tubel
6,068,053 A 5/2000 Shaw
6,075,462 A 6/2000 Smith
6,125,938 A 10/2000 Garcia-Soule
6,160,492 A 12/2000 Herman
6,161,618 A 12/2000 Parks
6,179,057 B1 1/2001 Fontana
6,209,640 B1 4/2001 Reimers
6,247,536 B1 6/2001 Leismer
6,257,332 B1 7/2001 Vidrine
6,271,766 B1 8/2001 Didden
6,276,454 B1 8/2001 Fontana
6,279,660 B1 8/2001 Hay
6,281,489 B1 8/2001 Tubel
6,288,975 B1 9/2001 Frederick
6,296,066 B1 10/2001 Terry
6,315,461 B1 11/2001 Cairns
6,422,315 B1 7/2002 Dean
6,469,636 B1 10/2002 Baird
6,484,806 B2 11/2002 Childers
6,498,988 B1 12/2002 Robert
6,670,880 B1 12/2003 Hall
6,736,545 B2 5/2004 Cairns
6,788,980 B1 9/2004 Johnson
6,801,135 B2 10/2004 Schultz
6,816,082 B1 11/2004 Laborde
6,851,444 B1 2/2005 Kohl et al.
6,896,055 B2 5/2005 Koithan
6,901,464 B2 5/2005 Risi
7,216,714 B2 5/2007 Reynolds
7,261,162 B2 8/2007 Deans
7,328,741 B2 2/2008 Allen
7,576,447 B2 8/2009 Biester
7,695,301 B2 4/2010 Mudge, III
7,921,917 B2 4/2011 Kotrla
8,149,133 B2 4/2012 Milne
8,159,365 B2 4/2012 Milne
8,212,378 B2 7/2012 Biester
8,463,549 B1 * 6/2013 Selman ..... E21B 7/04 702/9
8,511,388 B2 8/2013 Milne
8,511,389 B2 8/2013 Fenton
8,734,026 B2 5/2014 Nagengast
9,057,846 B2 6/2015 Xi
9,184,451 B2 11/2015 Bennett
9,281,906 B2 3/2016 Choudhury
9,291,020 B2 3/2016 McWhorter
9,322,264 B2 4/2016 Gutierrez
9,422,782 B2 8/2016 McWhorter
9,475,502 B2 10/2016 Fung
9,658,130 B2 5/2017 Veeningen
9,803,448 B2 10/2017 Holmes
9,879,526 B2 1/2018 Jaffrey
9,970,287 B2 5/2018 Jaffrey
10,000,987 B2 6/2018 Springett
10,018,007 B2 7/2018 Panicker-Shah
10,030,499 B2 * 7/2018 Johnston ..... E21B 44/00
10,048,673 B2 8/2018 Holmes
10,196,871 B2 2/2019 Holmes
10,202,839 B2 2/2019 Scott
10,246,994 B2 4/2019 Jaffrey
10,404,052 B2 9/2019 Brooks
10,539,010 B2 1/2020 Gutierrez
10,545,803 B2 1/2020 Holmes
10,787,877 B2 9/2020 Pedersen
10,788,543 B2 9/2020 Emerich
10,876,369 B2 12/2020 Holmes
11,035,217 B2 6/2021 Holmes
11,136,857 B2 10/2021 Cramm
11,180,967 B2 11/2021 Pedersen
11,480,023 B2 10/2022 Sakhawat
11,519,237 B2 12/2022 Holmes
11,555,372 B1 1/2023 Al-Mousa
11,692,410 B2 7/2023 Holmes
11,753,899 B2 9/2023 Manett
11,824,682 B1 11/2023 Chen et al.
2004/0015618 A1 1/2004 Risi
2004/0015619 A1 1/2004 Brown
2004/0205111 A1 10/2004 Chasmawala
2004/0262008 A1 12/2004 Deans
2007/0107904 A1 5/2007 Donahue
2008/0082630 A1 4/2008 Molotchko
2009/0194290 A1 8/2009 Parks
2009/0265395 A1 10/2009 Milne
2009/0288836 A1 11/2009 Goodall
2010/0011853 A1 1/2010 Anthony
2010/0171637 A1 7/2010 Jaffrey
2011/0080915 A1 4/2011 Baykal
2011/0100710 A1 5/2011 Fossli
2011/0304218 A1 12/2011 Hyland
2012/0000646 A1 1/2012 Liotta
2012/0098674 A1 4/2012 McStay
2012/0132430 A1 5/2012 Ebenezer
2012/0197527 A1 * 8/2012 McKay ..... E21B 33/064 702/6
2013/0058192 A1 3/2013 Gateman
2013/0083627 A1 4/2013 Yates
2013/0103208 A1 4/2013 Niemeyer
2013/0144531 A1 6/2013 Johnston
2013/0153241 A1 6/2013 Mallinson
2013/0341094 A1 12/2013 Taherian
2014/0023365 A1 1/2014 Xi
2014/0064029 A1 3/2014 Jaffrey
2014/0311735 A1 10/2014 Landrith, II
2015/0094866 A1 * 4/2015 Pereira ..... E21B 33/0355 700/282
2015/0219791 A1 8/2015 Eccles
2015/0331971 A1 11/2015 Scollard
2016/0001781 A1 1/2016 Fung
2017/0139404 A1 * 5/2017 Anand ..... G05B 19/4155
2017/0314357 A1 11/2017 Kent
2017/0359128 A1 12/2017 Xi
2018/0083715 A1 3/2018 Greene
2019/0007794 A1 1/2019 Thakur
2019/0085468 A1 3/2019 Amaya
2019/0368299 A1 12/2019 Jorud
2020/0150642 A1 * 5/2020 Thwaites ..... G06F 3/04847
2020/0162283 A1 5/2020 Mo
2020/0182004 A1 6/2020 Tesla
2020/0190931 A1 6/2020 Moen
2020/0192467 A1 6/2020 Capgolu
2020/0332653 A1 10/2020 Gutierrez
2021/0105619 A1 4/2021 Kashani
2021/0152391 A1 5/2021 Mo
2021/0262312 A1 8/2021 Holmes
2022/0018205 A1 1/2022 Holmes
2022/0282587 A1 9/2022 Ducamin
2023/0118770 A1 4/2023 Jia
2023/0279734 A1 9/2023 Rakhunde

FOREIGN PATENT DOCUMENTS

EP 2383429 A3 7/2015
GB 2284257 B 6/1998
GB 2361597 A 10/2001
GB 2477034 A 7/2011

(56) References Cited

FOREIGN PATENT DOCUMENTS

| | | | |
|---|---|---|---|
| GB | 2478761 | A | 9/2011 |
| KR | 10-2028046 | B1 | 10/2019 |
| OA | 17804 | A | 1/2018 |
| WO | 1998020506 | A1 | 5/1998 |
| WO | 1998007049 | A9 | 7/1998 |
| WO | 2001054140 | A1 | 7/2001 |
| WO | 2002006716 | A1 | 1/2002 |
| WO | 2020251821 | A1 | 12/2020 |
| WO | 2021076704 | A1 | 4/2021 |
| WO | 2022066896 | A1 | 3/2022 |
| WO | 2023039052 | A1 | 3/2023 |
| WO | 2023083432 | A1 | 5/2023 |

OTHER PUBLICATIONS

Search Report and Written Opinion of International Patent Application No. PCT/US2021/072438 dated Mar. 10, 2022; 9 pages.
Office Action issued in U.S. Appl. No. 18/510,852 dated Aug. 14, 2024, 36 pages.

* cited by examiner

INTERACTIVE MONITORING AND CONTROL SYSTEM FOR A MINERAL EXTRACTION SYSTEM

CROSS-REFERENCE TO RELATED APPLICATION

The present document is a National Stage Entry of International Application No. PCT/US2021/072438, filed Nov. 16, 2021, which is based on and claims priority to U.S. Provisional Patent Application No. 63/198,875, filed Nov. 19, 2020, which is incorporated herein by reference in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources have a profound effect on modern economies and societies. In order to meet the demand for such natural resources, numerous companies invest significant amounts of time and money in searching for, accessing, and extracting oil, natural gas, and other natural resources. For example, once a desired natural resource is discovered below the surface of the earth, mineral extraction systems are often employed to access the desired natural resource. These mineral extraction systems can be located onshore or offshore depending on the location of the desired natural resource.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
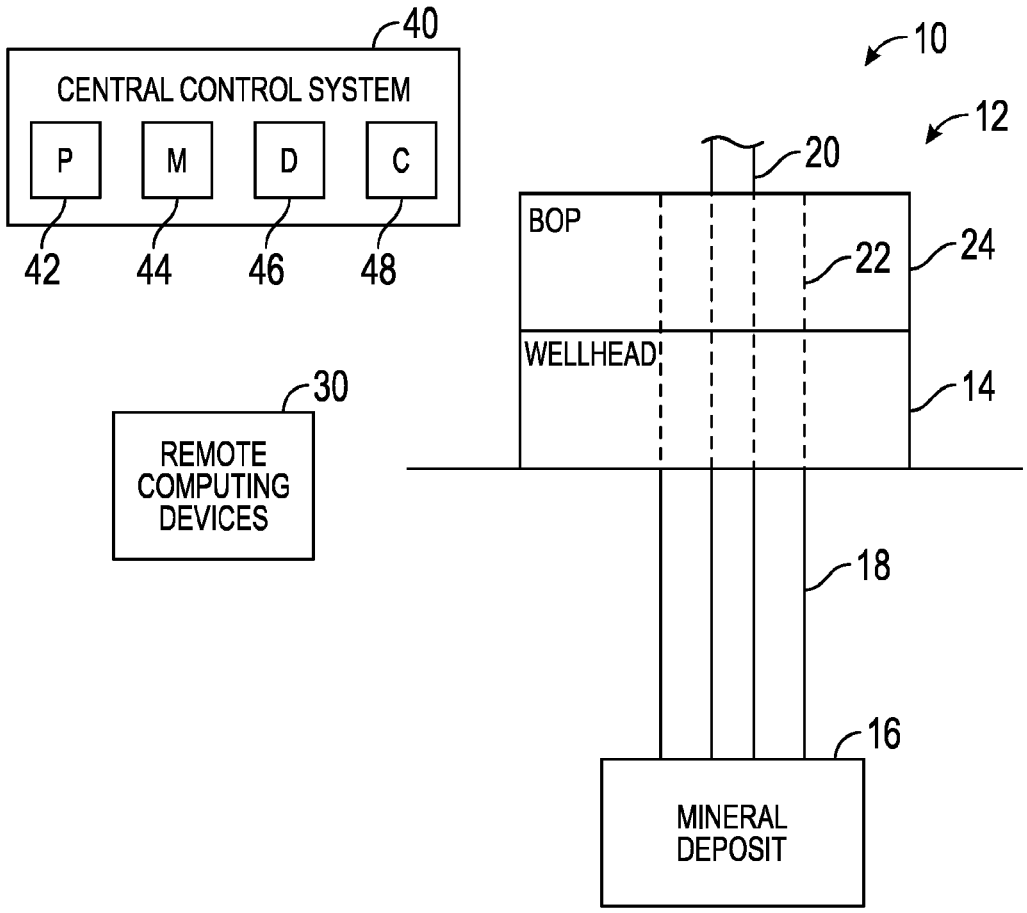
FIG. 1 is a schematic diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof. Numerical terms, such as "first," "second," and "third" may be used to distinguish components to facilitate discussion, and it should be noted that the numerical terms may be used differently or assigned to different elements in the claims. The drawing figures are not necessarily to scale. Certain features and components herein may be shown exaggerated in scale and/or in somewhat schematic form. Some details may not be shown in the interest of clarity and conciseness.

A mineral extraction system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore. The mineral extraction system may include a stack assembly that includes one or more blowout preventers (e.g., annular blowout preventers and/or ram blowout preventers). The mineral extraction system may also include various other components, such as conduits (e.g., pipes), valves, accumulators, controllers, and the like to facilitate drilling operations and other operations (e.g., intervention operations). It is presently recognized that it would be desirable to provide an interactive monitoring and control system for the mineral extraction system that enables a user to visualize substantially real-time data related to the mineral extraction system in a convenient, clear format (e.g., easy-to-read) and/or that enables the user to control the drilling system in an efficient, intuitive manner.

With the foregoing in mind, FIG. 1 is a block diagram of an embodiment of a system 10 (e.g., a mineral extraction system). The system 10 may be configured to extract various minerals and natural resources, including hydrocarbons (e.g., oil and/or natural gas), from the earth and/or to inject substances into the earth. The system 10 may be a land-based system (e.g., a surface system) or an offshore system (e.g., an offshore platform system).

A BOP stack 12 may be mounted to a wellhead 14, which is coupled to a mineral deposit 16 via a wellbore 18. The wellhead 14 may include or be coupled to any of a variety of other components such as a spool, a hanger, and a "Christmas" tree. The wellhead 14 may return drilling fluid or mud toward a surface during drilling operations, for example. Downhole operations are carried out by a conduit 20 (e.g., drill string) that extends through a central bore 22 of the BOP stack 12, through the wellhead 14, and into the wellbore 18. As shown, the BOP stack 12 may include one or more BOPs 24 (e.g., ram BOPs).

It should be appreciated that the system 10 may include additional components, such as a lower marine riser package (LMRP), a diverter, conduits, valves, accumulators, and/or controllers (e.g., control pods). Furthermore, sensors may be positioned about the system 10 to monitor various properties (e.g., pressure, flow rate, valve position) of the components of the system 10 and/or various properties of fluid within the system 10. The sensors may provide sensor data indicative of the various properties to a central control system 40 (e.g., server), which may be located at a wellsite and/or remote from the wellsite (e.g., hundreds of kilometers or more from the wellsite).

The central control system 40 may include one or more processors 42 and one or more memory devices 44. The one or more processors 42 may execute instructions stored on the one or more memory devices 44 to analyze the sensor data and to generate one or more outputs based on the sensor data for display via a display 46 (e.g., display screen). The display 46 may be configured to display information for visualization by a user (e.g., an operator). The display 46 may be a touchscreen display that is capable of receiving inputs from the user; however, the central control system 40 may be configured to receive inputs from the user via other input devices (e.g., push buttons). Indeed, the central control system 40 may include any of a variety of input and/or output devices (e.g., lights, speakers, push buttons, the display 46) to receive sensor data and/or to provide information to the user. The central control system 40 may also include a communication device 48 to facilitate receipt of the sensor data, to facilitate transmission of control signals from the one or more processors 42 to the components of the system 10 (e.g., to the one or more BOPs 24), and/or to facilitate communication with remote computing devices 30 (e.g., client devices) over a network (e.g., the Internet).

Each remote computing device 30 may include a display. The central control system 40 may provide the information for display on the display of the remote computing device 30. In some embodiments, the central control system may provide the information via a webpage that is accessible using the remote computing device 30. More particularly, the user may use the remote computing device 30 to request access to the webpage from the central control system 40. Then, the central control system 40 may provide access to the webpage that includes a user interface, such as an intelligent graphical human-machine interface (HMI) that may be used to control the components of the system 10 (e.g., controllable components, such as the one or more BOPs 24). The user interface may also include an animation with substantially real-time information related to the various properties. Thus, the user may use the remote computing device 30 to provide inputs to control the components of the system 10 (e.g., to modify the various properties, such as to adjust a valve of the system 10) and/or to view the substantially real-time information on the display of the remote computing device 30. The inputs may be communicated to the central control system 40 to enable the user to control the components of the system 10 and/or the display of the remote computing device 30 may be updated (e.g., re-render graphical objects in the animation) to reflect the modifications to the various properties and/or any other changes to the various properties to thereby provide the user with relevant, up-to-date information about the system 10.

Figure 2:
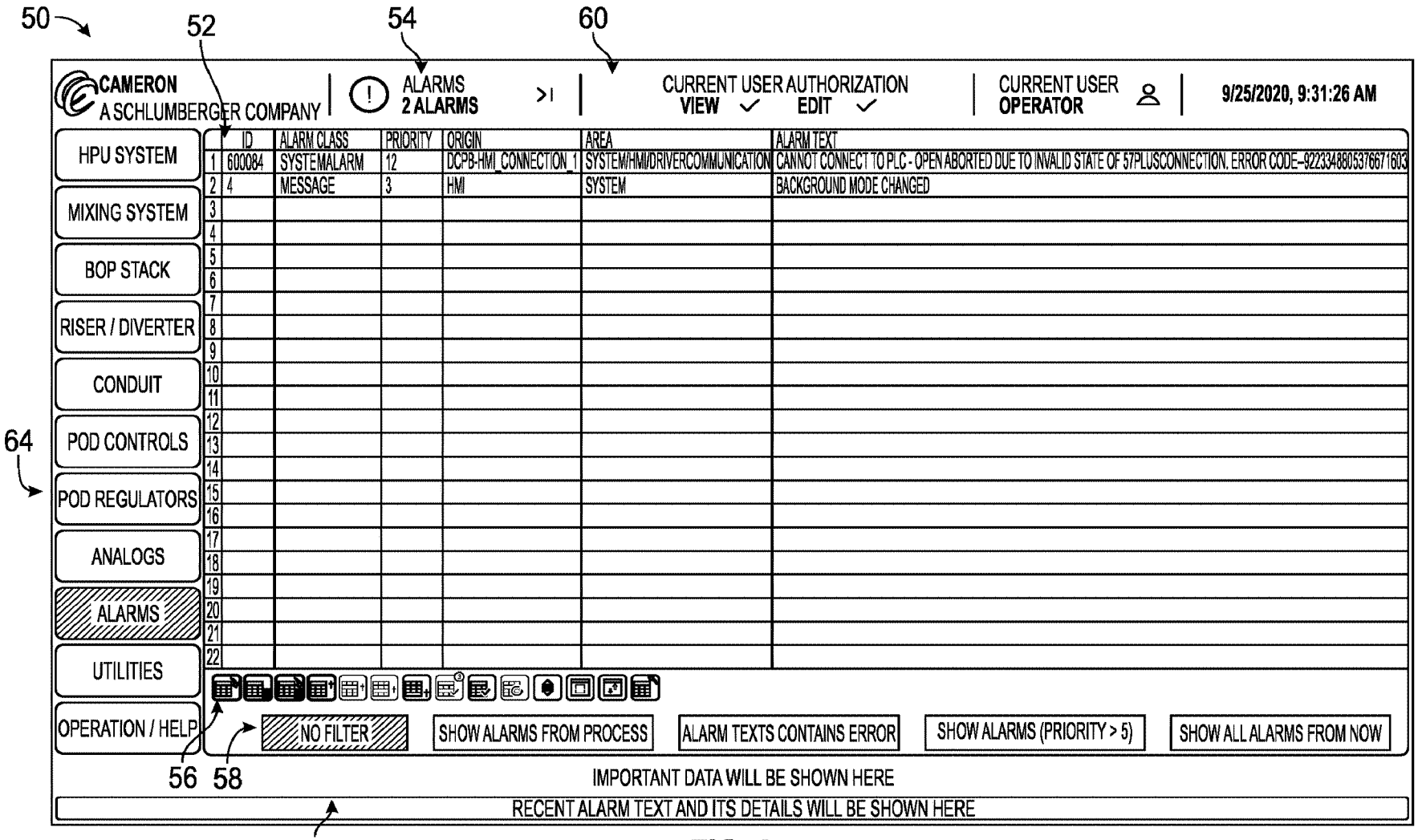
FIG. 2 illustrates a user interface that provides alarm information, in accordance with an embodiment of the present disclosure.

With the foregoing in mind, FIGS. 2-14 illustrate various user interfaces that may be presented via a display (e.g., the display 46 and/or the display of the remote computing device 30) for visualization by the user. In particular, as shown in FIG. 2, a user interface 50 may provide alarm information and may enable manipulation of the alarm information by the user. The alarm information may include a list of alarms 52 that have been triggered (e.g., due to sensor data being outside of acceptable ranges, due to communication failures, due to changes to preferences). In FIG. 2, the list of alarms 52 includes a first alarm related to a communication failure and a second alarm related to a change in a preference (e.g., background mode). A total number of the alarms 54 may be provided in a header at a top section, a tool bar 56 that enables manipulation of the list of alarms (e.g., filtering, sorting, graphing, setting of customized rules for filtering and sorting) by the user may be provided adjacent to the list of alarms, and a shortcut tool bar 58 that includes most-frequently used or preferred tools for manipulation of the list of alarms by the user may be provided adjacent to the list of alarms. For example, the alarms may be assigned a priority value, and the shortcut tool bar 58 may include an option to "Show alarms (priority >5)" to enable the user to efficiently view the alarms that have respective priority values that are greater than 5.

As shown in FIG. 2, the user interface 50 may also include a user summary 60 in the header at the top section. In order to access the webpage and the user interfaces in FIGS. 2-14, the user may have to complete a login process and/or the remote computing device 30 may be associated with the user. In such cases, the user summary 60 may include an identifier of the user (e.g., name, title) and/or an authorization status of the user (e.g., whether the user has authority or permission to view the information, to modify the various properties/control the components of the system 10 of FIG. 1, or both). Because the user may be logged in or otherwise identified, any changes to the system 10 of FIG. 1 commanded by the user may be tracked and associated with the user (e.g., in a database, which may be stored in the one or more memory devices 44 of FIG. 1). The user interface may also include a time and date in the header at the top section. Additionally, the user interface 50 may include a summary of important data (e.g., whether BOPs are open or closed, high pressure conditions detected) and/or recent alarm details 62 in a footer at a bottom section. The user interface 50 may also include a menu 64 that the user may utilize to navigate through various user interfaces (e.g., via selection of tabs in the menu 64), including some or all of the user interfaces of FIGS. 2-14.

Figure 3:
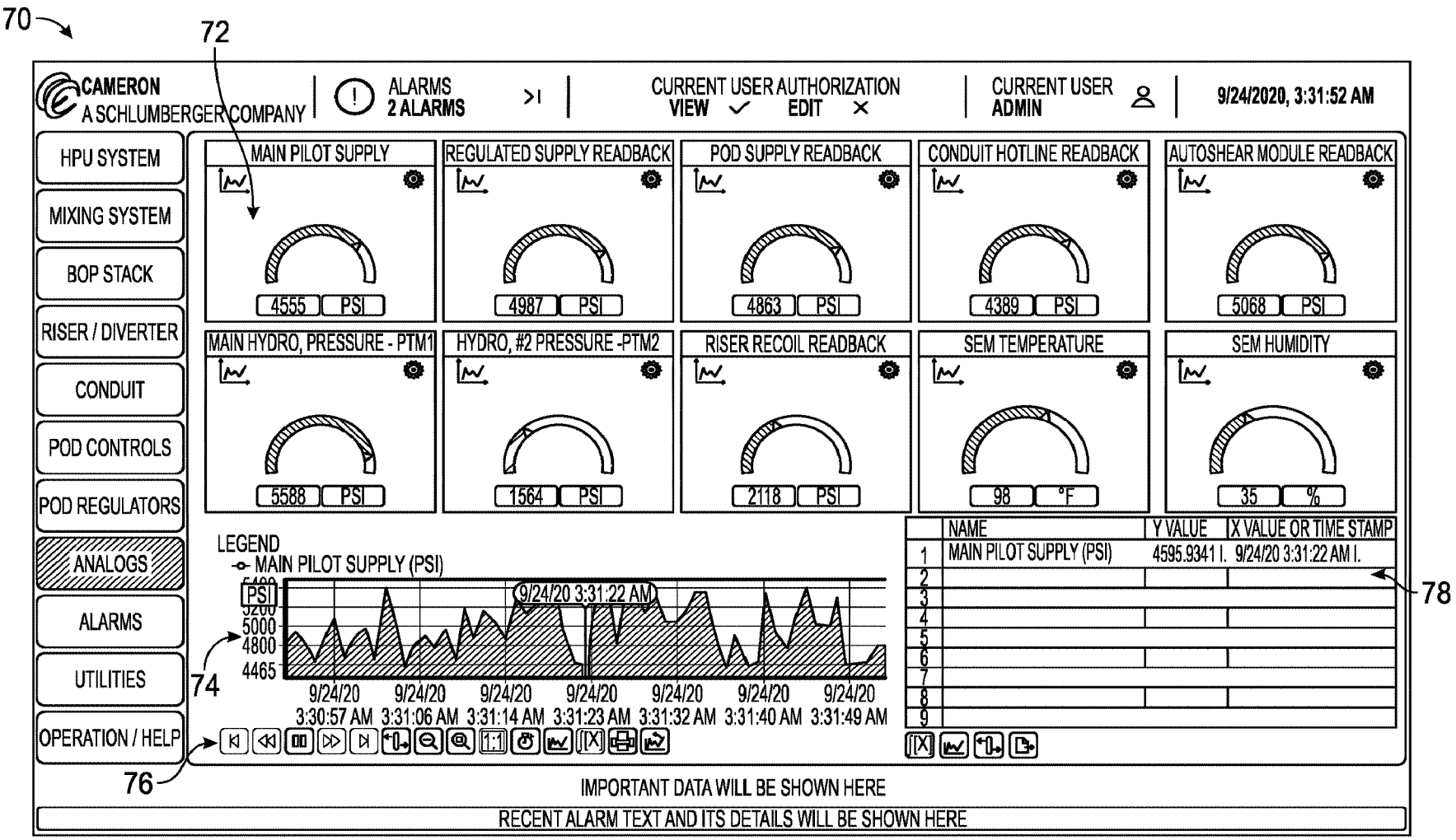
FIG. 3 illustrates a user interface that provides sensor data in a gauge format, in accordance with an embodiment of the present disclosure.

In FIG. 3, a user interface 70 may provide sensor data in a gauge format. As noted above, the sensor data may be obtained from sensors that are positioned about the system 10 of FIG. 1. For example, each gauge 72 may show a current value of a respective property (e.g., pressure) as monitored by one of the sensors that are positioned about the system 10 of FIG. 1. Each gauge 72 may show the respective property numerically and/or via color (e.g., green is within target ranges, yellow is outside of target ranges). The user may select one of the gauges 72 to thereby view a trend in the respective property over time in a graph 74. A tool bar 76 may be provided adjacent to the graph 74 and may enable the user to view the property over certain time windows, for example. Additionally, a table 78 may be provided adjacent to the graph 74 to enable the user to view the property at a particular time (e.g., previous time) via selection of the particular time in the graph 74. Upon selection of multiple times in the graph 74, a table tool bar may be used to perform calculations on the data in the table 78 (e.g., averaging).

Figure 4:
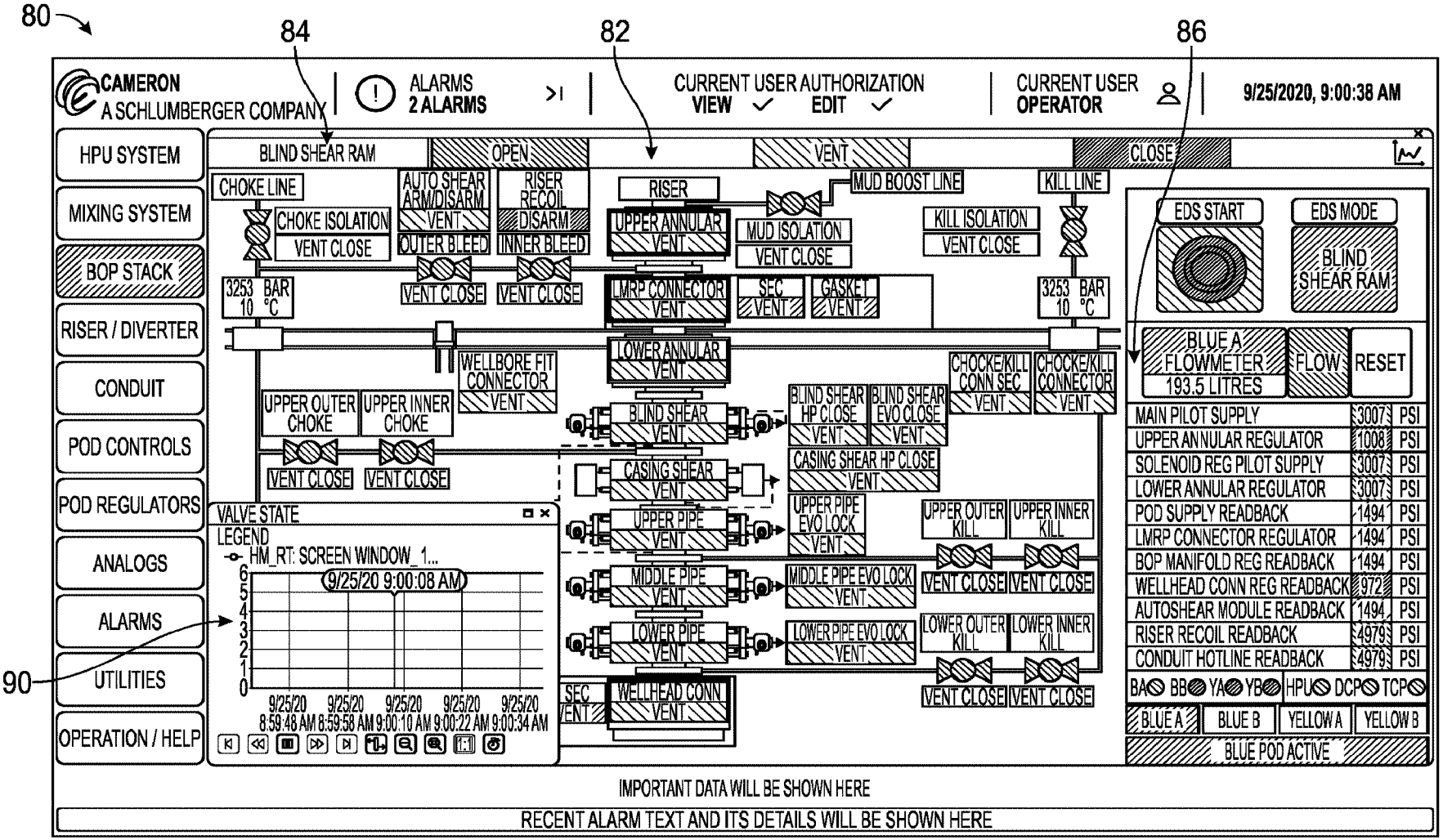
FIG. 4 illustrates a user interface that provides a representation of a stack assembly and related components, in accordance with an embodiment of the present disclosure.

In FIG. 4, a user interface 80 may provide a representation 82 of a BOP stack (e.g., the BOP stack 12 of FIG. 1) and/or additional components (e.g., the LMRP, conduits, valves). The representation 82 of the BOP stack may include one or more ram BOPs and/or annular BOPs stacked relative to one another, as well as a status of each BOP adjacent to and/or overlaid onto the BOP (e.g., open, vented, closed). The representation 82 may also include a status of each valve adjacent to and/or overlaid onto the valve (e.g., open, vented, closed). The status may be labeled via text and/or color (e.g., red for closed). The representation 82 may make it easier for the user to visualize the arrangement of the components and the status of the components.

A control bar 84 may be provided adjacent to the representation 82, and the user may control a particular component by selecting the component (e.g., which may then be highlighted, as shown in blue in FIG. 3) and then selecting a control command (e.g., open, vented, closed in the control bar 84). The representation 82 may also include the controllable component (e.g., the rams) and may illustrate movement of the controllable component in the representation 82 in response to the user providing inputs to move the controllable component. The user interface 80 may enable the user to interact with the information about the BOP stack and/or the additional components in other ways. For example, the user interface 80 may include a table 86 of a current value of a respective property (e.g., pressure) as monitored by one of the sensors positioned about the system 10 of FIG. 1. The user interface 80 may also include a graph 90 that shows a trend in the respective property over time. The control bar 84, the table 86, and/or the graph 90 may not be displayed at all times. Instead, the user may request display of these features, such as by selecting one of the components in the representation 82.

Figure 5:
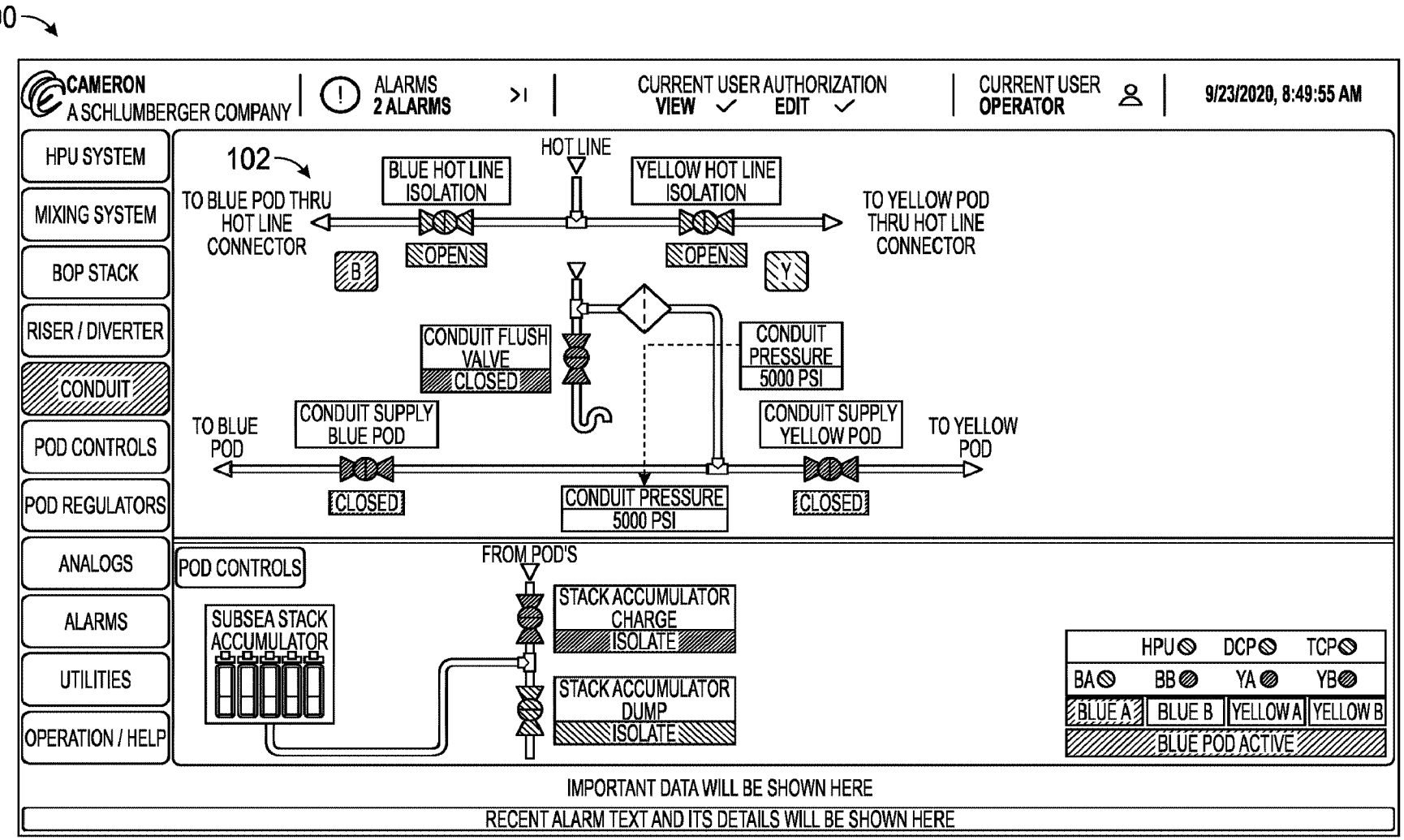
FIG. 5 illustrates a user interface that provides a schematic diagram of fluid conduits and related components, in accordance with an embodiment of the present disclosure.

In FIG. 5, a user interface 100 may provide a representation 102 of various components (e.g., conduits, accumulator, valves) that may be used in the system 10 of FIG. 1. The representation 102 may include a status of each component adjacent to and/or overlaid onto the component (e.g., open, vented, closed, pressure reading). The status may be labeled via text and/or color (e.g., red for closed). The representation 102 may make it easier for the user to visualize the arrangement of the components and the status of the components. The user interface 100 may enable the user to interact with the information about the components and/or control the components in a way that is similar to the techniques discussed above with respect to FIG. 4. For example, the user may request display of the information and/or control one of the components by selecting the component in the representation 102. It should be appreciated that other components may be shown in the representation 102 and/or in other representations that are accessible via the menu.

Figure 6:
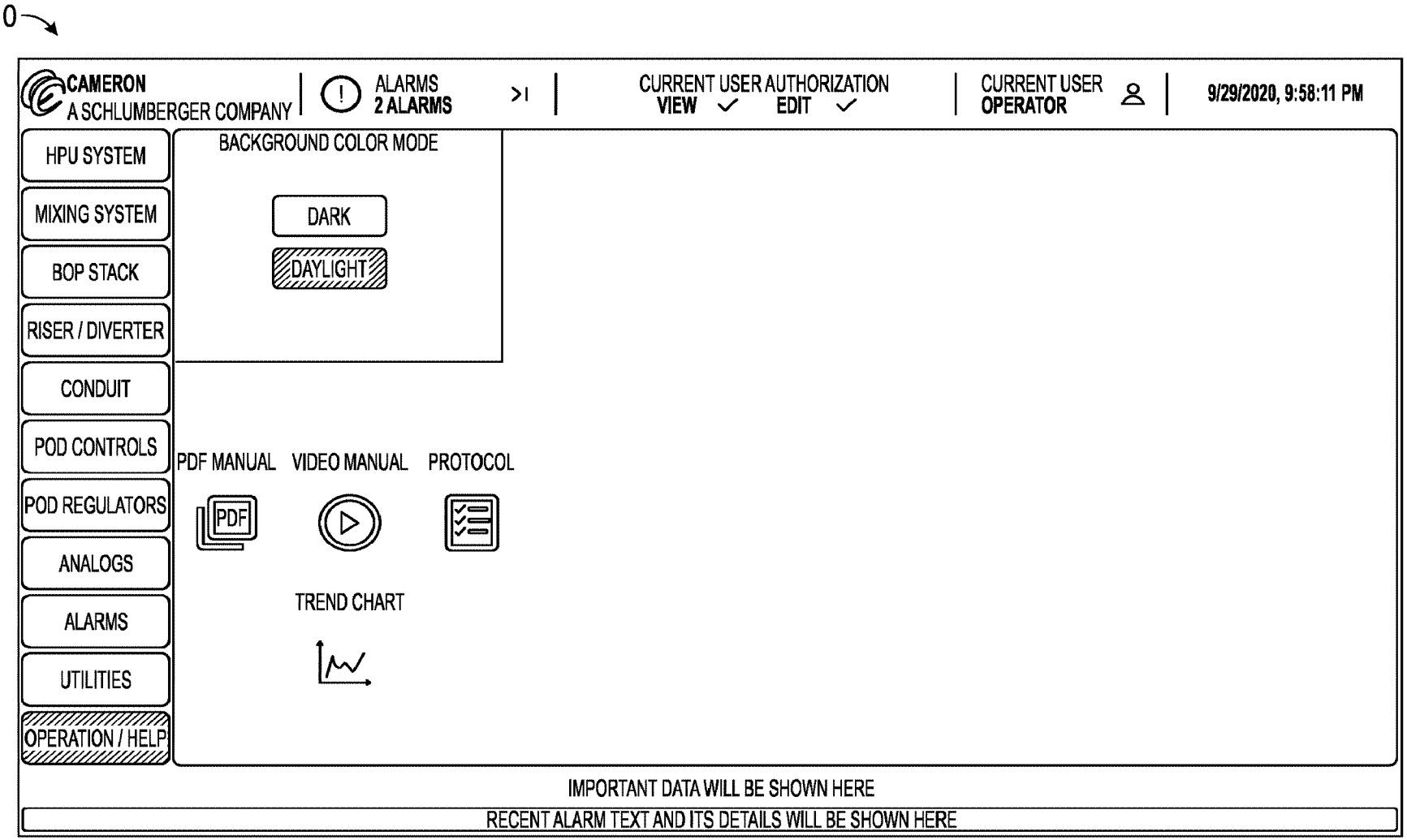
FIG. 6 illustrates a user interface that provides operational assistance information, in accordance with an embodiment of the present disclosure.
Figure 7:
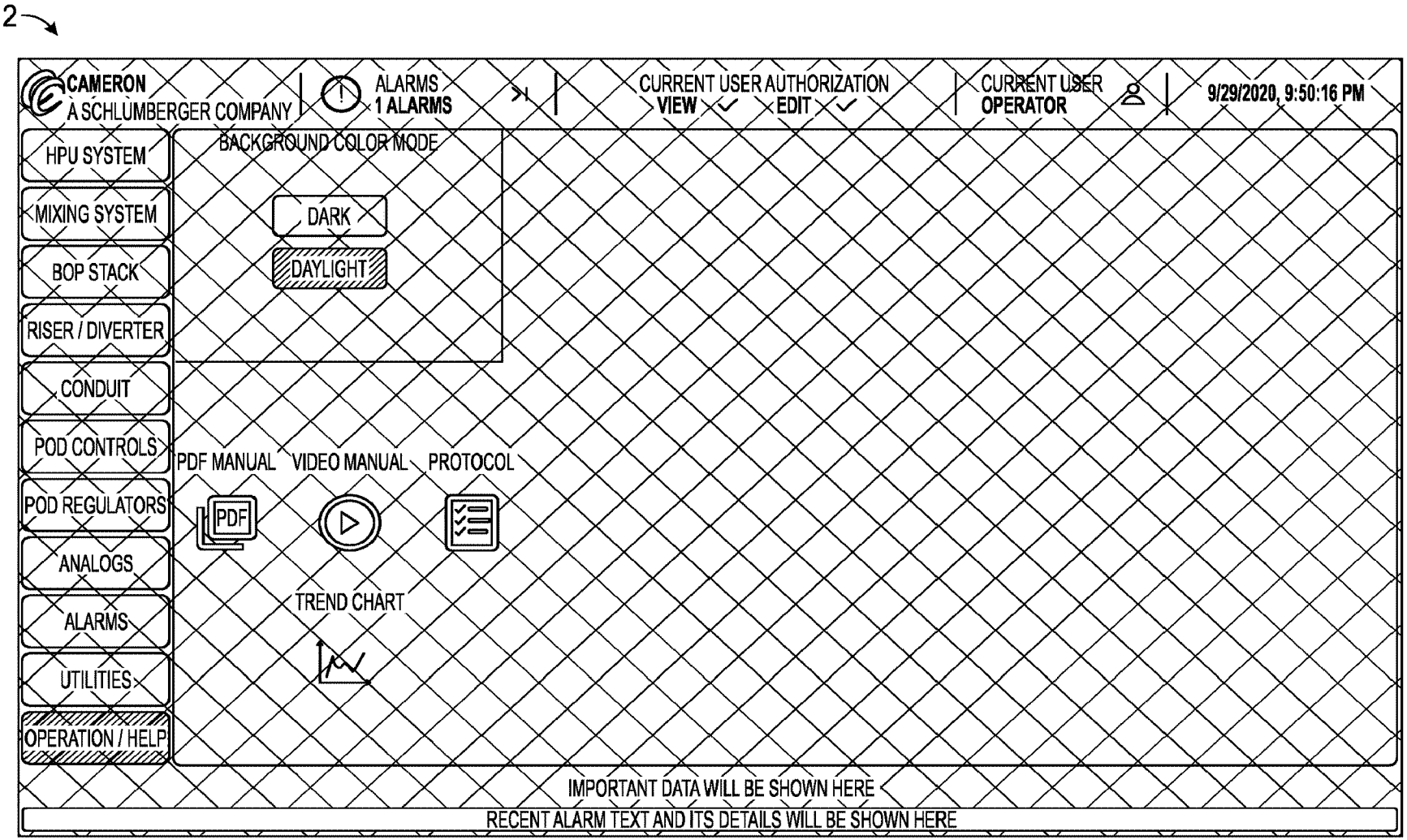
FIG. 7 illustrates a user interface that provides the operational assistance information with a dark background mode, in accordance with an embodiment of the present disclosure.
Figure 8:
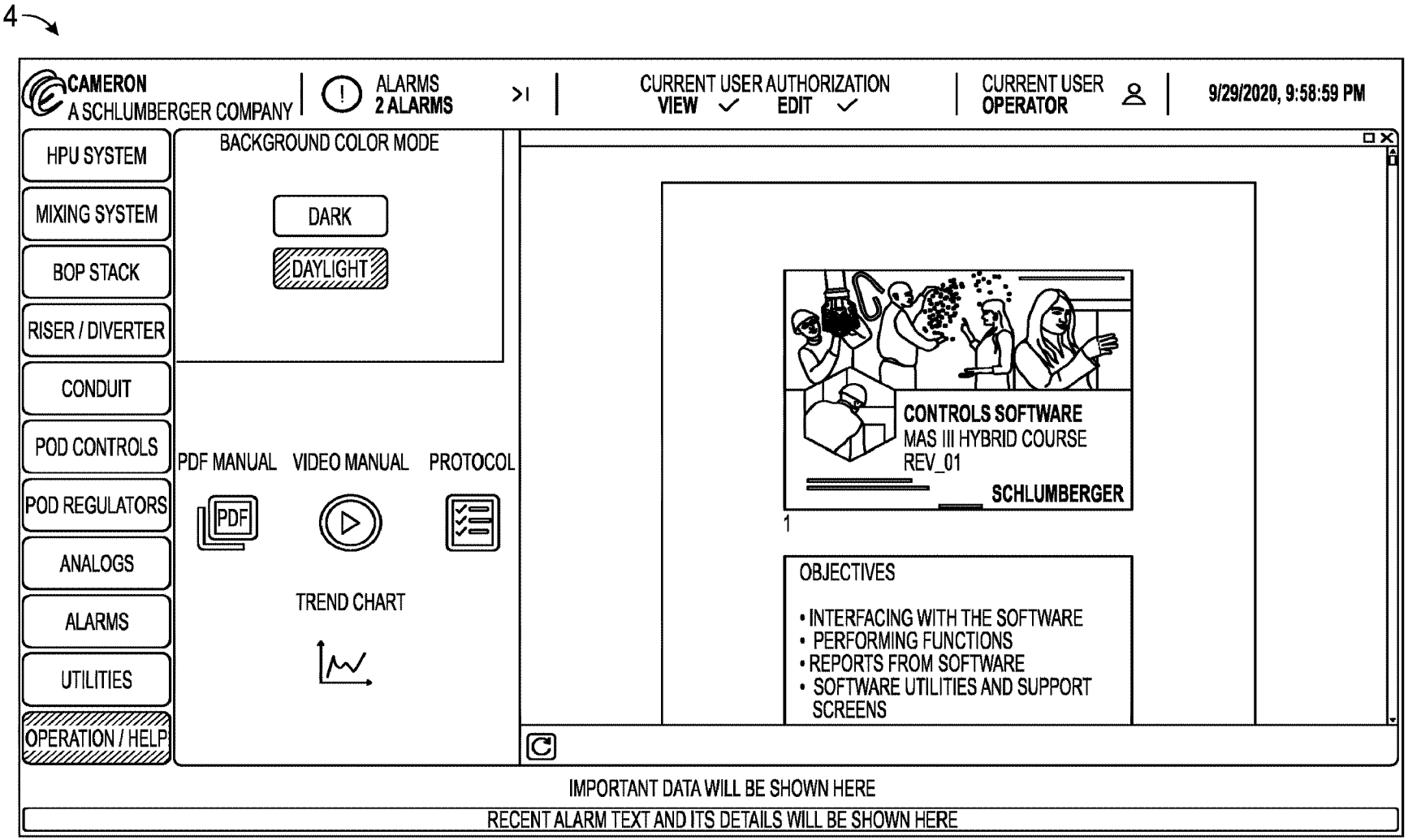
FIG. 8 illustrates a user interface that provides a manual related to the operational assistance information, in accordance with an embodiment of the present disclosure.

In FIG. 6, a user interface 110 may provide operational assistance information and/or guidance for the user. For example, by selecting a "help" tab in the menu, the user may be directed to the user interface 110 that provides the user with an option to select a "PDF Manual," a "Video Manual," and/or a "Protocol," to guide the user through steps to analyze the information and/or to control the components of the system 10 of FIG. 1. The user interface 110 may also include a section that enables the user to input preferences, such as to change the background color mode (e.g., between the user interface 110 with a light mode shown in FIG. 6 and a user interface 112 with a dark mode shown in FIG. 7). It should be appreciated that once the background color mode is selected, that background color may be set for all subsequent user interfaces until the user makes another change to the background color mode. Upon selection of one of the help options, detailed operational assistance information may be displayed as shown in FIG. 8. For example, upon selection of the "PDF Manual," a user interface 114 with a detailed manual may be provided for visualization by the user.

Figure 9:
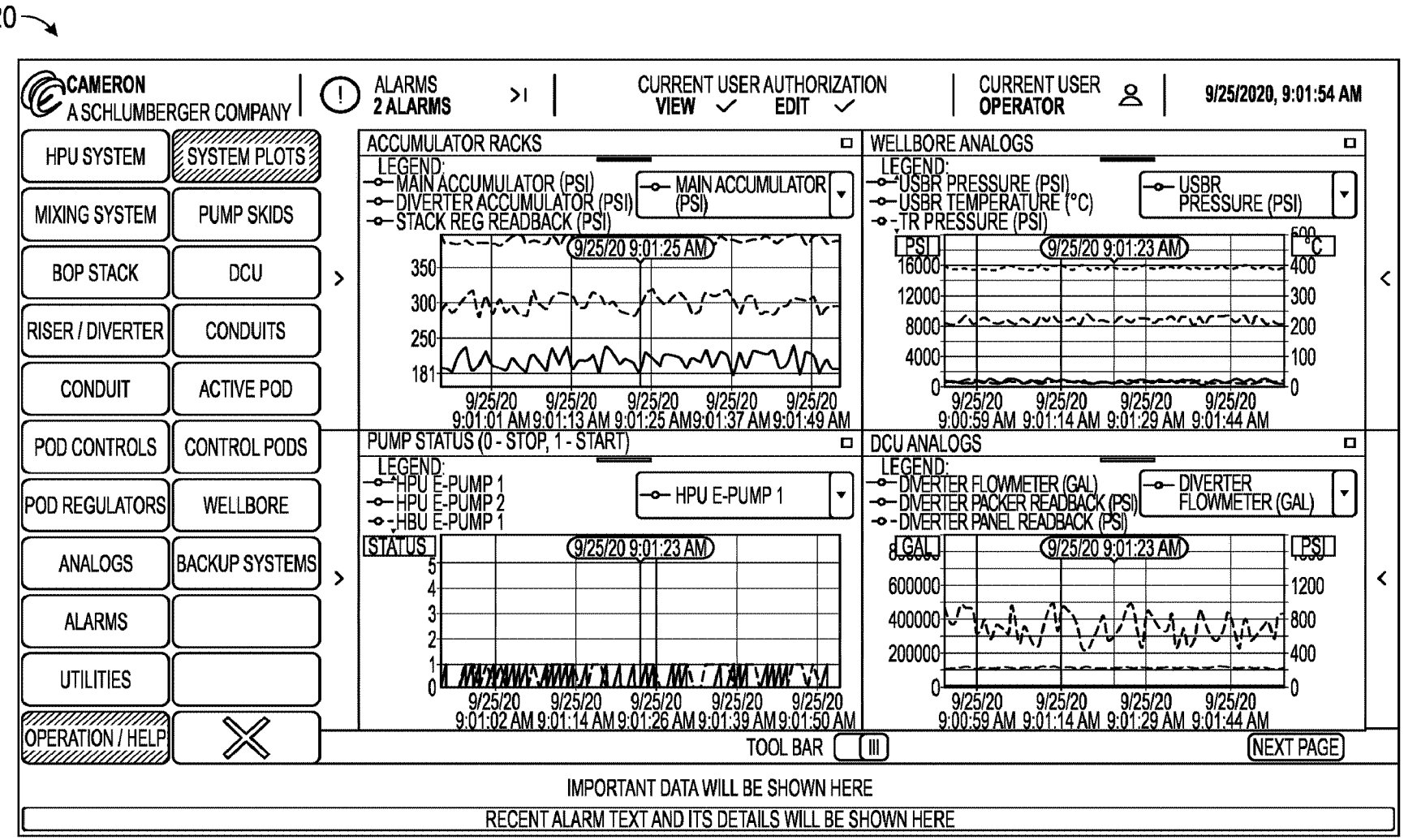
FIG. 9 illustrates a user interface that provides multiple graphs that shows trends in sensor data, in accordance with an embodiment of the present disclosure.
Figure 10:
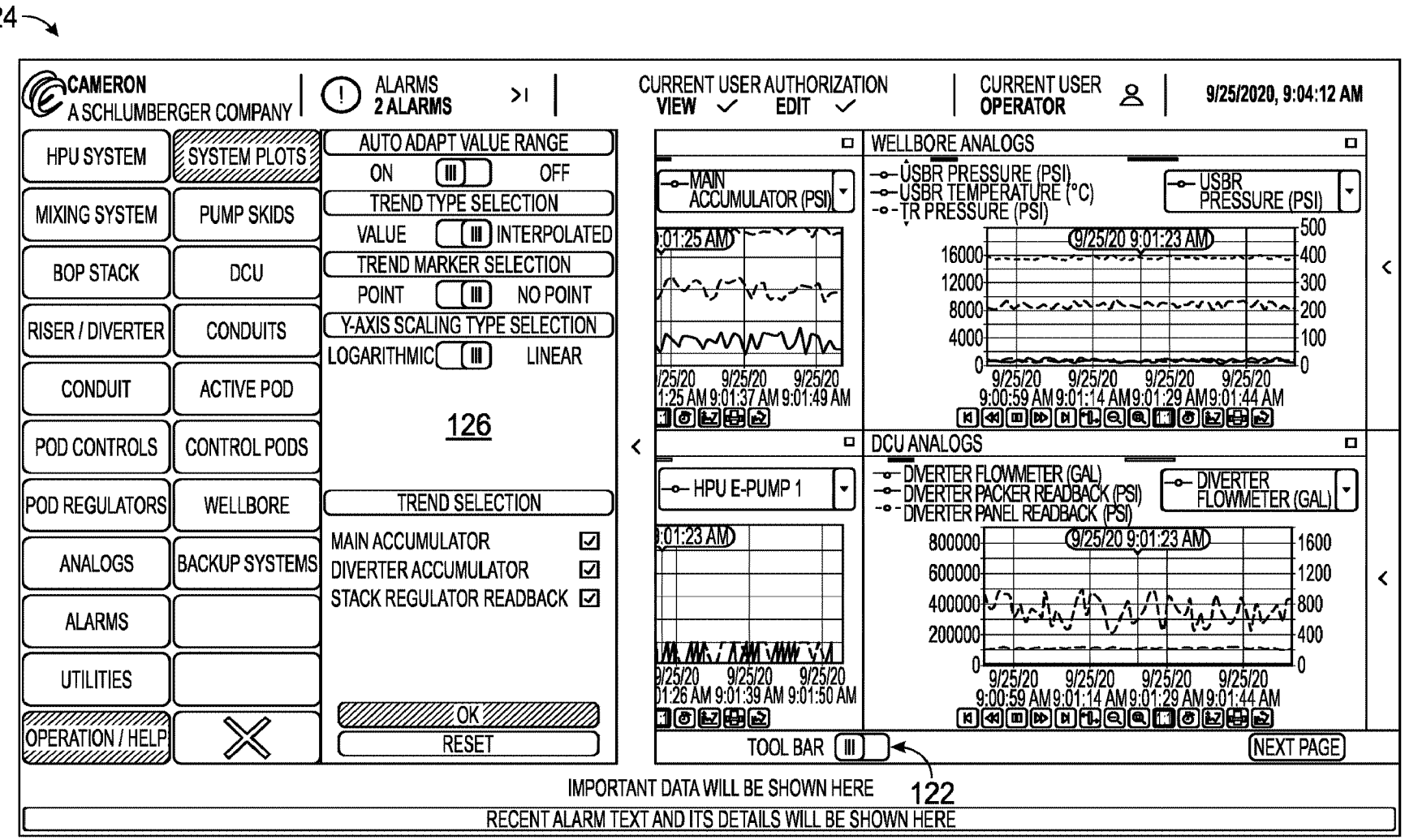
FIG. 10 illustrates a user interface that provides a pop-up tool bar that enables a user to set preferences for the multiple graphs, in accordance with an embodiment of the present disclosure.

In FIG. 9, a user interface 120 may provide one or more graphs that show trends in the various properties measured by the sensors positioned about the system 10 of FIG. 1. As shown in FIG. 10, upon selection of a tool bar tab 122, a user interface 124 may provide a pop-up tool bar 126 for preferences and/or options related to the one or more graphs of FIG. 9. For example, the pop-up tool bar 126 may enable the user to provide inputs related to trend type, scaling type, and the like to adjust the way in which the sensor data is displayed in the one or more graphs.

Figure 11:
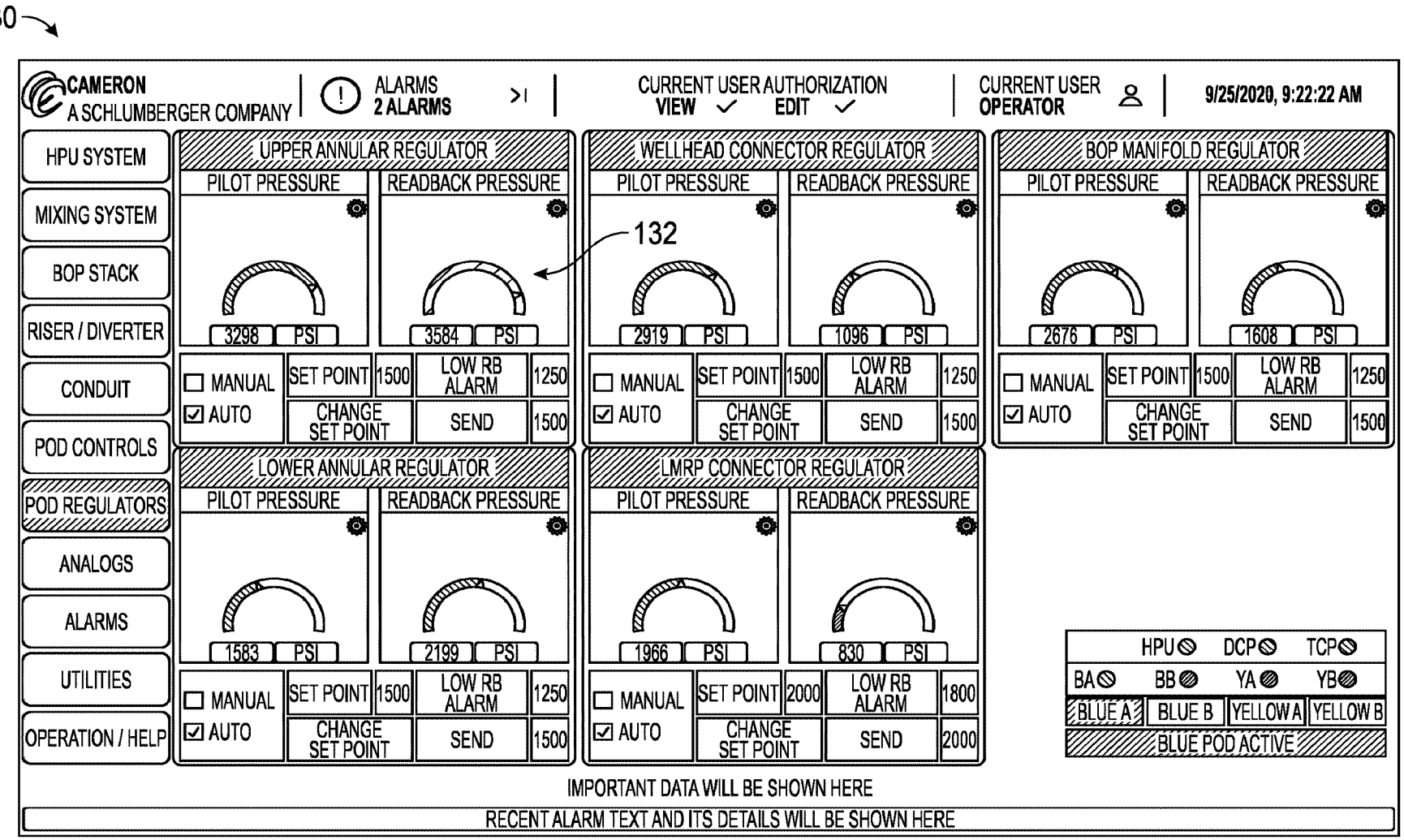
FIG. 11 illustrates a user interface that provides sensor data in a gauge format and virtual buttons that enable the user to set alarm preferences, in accordance with an embodiment of the present disclosure.

In FIG. 11, a user interface 130 may provide sensor data in a gauge format. As noted above, the sensor data may be obtained from sensors that are positioned about the system 10 of FIG. 1. For example, each gauge 132 may show a current value of a respective property (e.g., pressure) as monitored by one of the sensors that are positioned about the system 10 of FIG. 1. The user may easily view and/or adjust set points (e.g., alarm set points) for each gauge 132 (e.g., for each respective property) via virtual buttons adjacent to each gauge 132.

Figure 12:
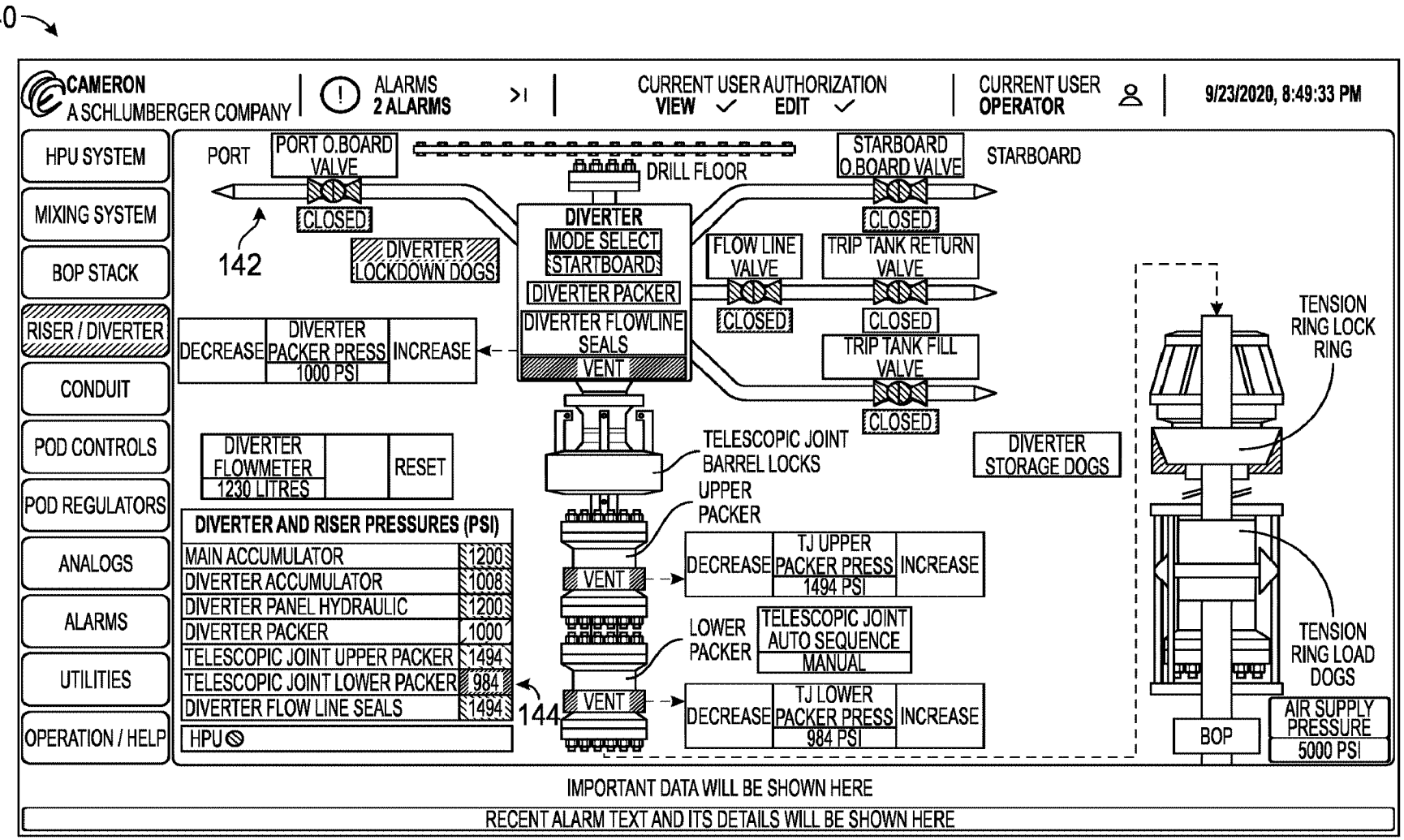
FIG. 12 illustrates a user interface that provides a representation of a diverter and related components, in accordance with an embodiment of the present disclosure.

In FIG. 12, a user interface 140 may provide a representation 142 of a diverter and/or additional components (e.g., conduits, valves) that may be used in the system 10 of FIG. 1. The representation 142 may include a status of each component adjacent to and/or overlaid onto the component (e.g., open, vented, closed, pressure). The status may be labeled via text and/or color (e.g., red for closed). The representation 142 may make it easier for the user to visualize the arrangement of the components and the status of the components. The user may control a particular component by selecting the component and/or selecting a control command (e.g., open, vented, closed, decrease, increase, mode). The user interface 140 may enable the user to interact with the information in other ways. For example, the user interface 140 may include a table 144 of a current value of a respective property (e.g., pressure) as monitored by one of the sensors positioned about the system 10 of FIG. 1.

Figure 13:
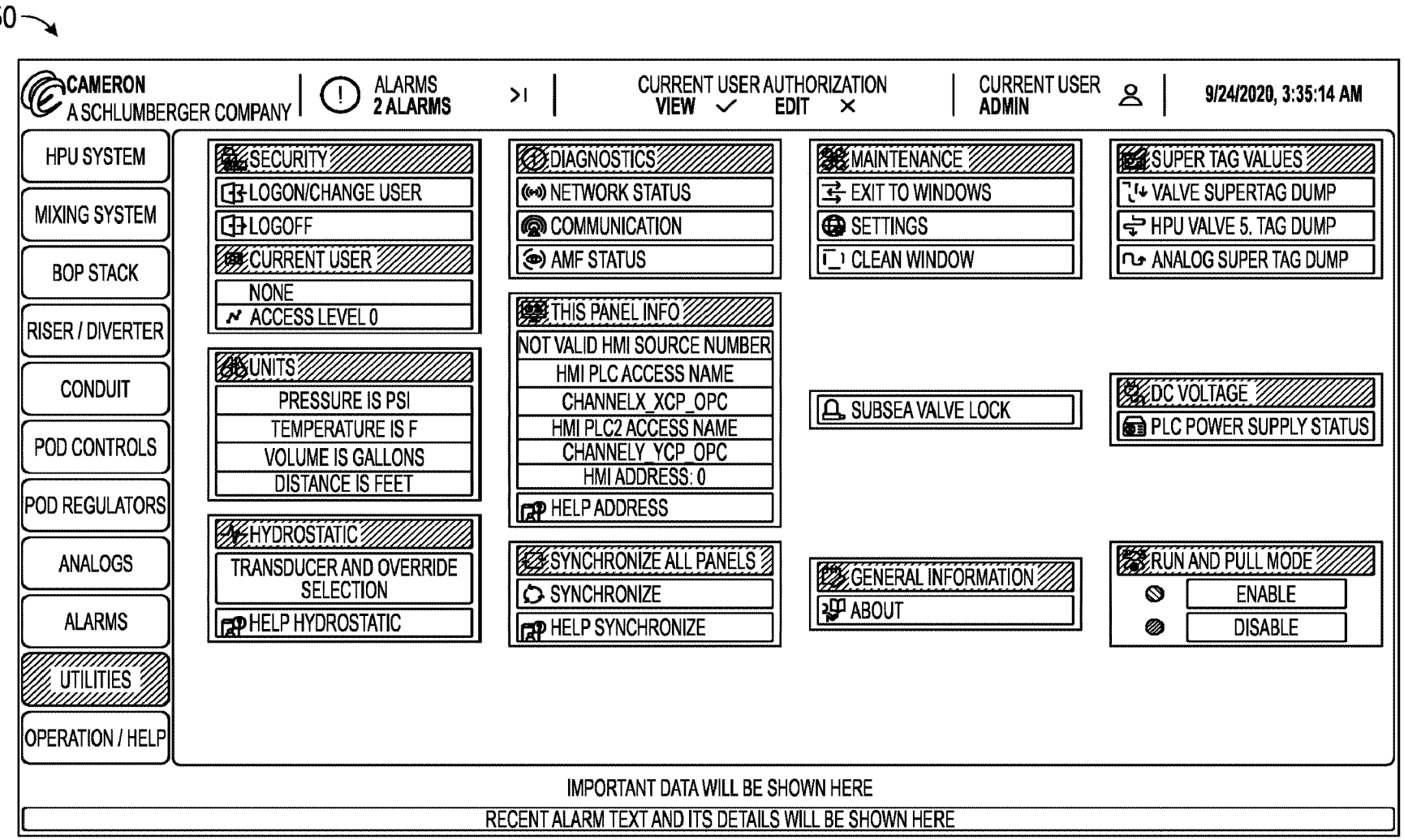
FIG. 13 illustrates a user interface that provides an overview of utilities, in accordance with an embodiment of the present disclosure.
Figure 14:
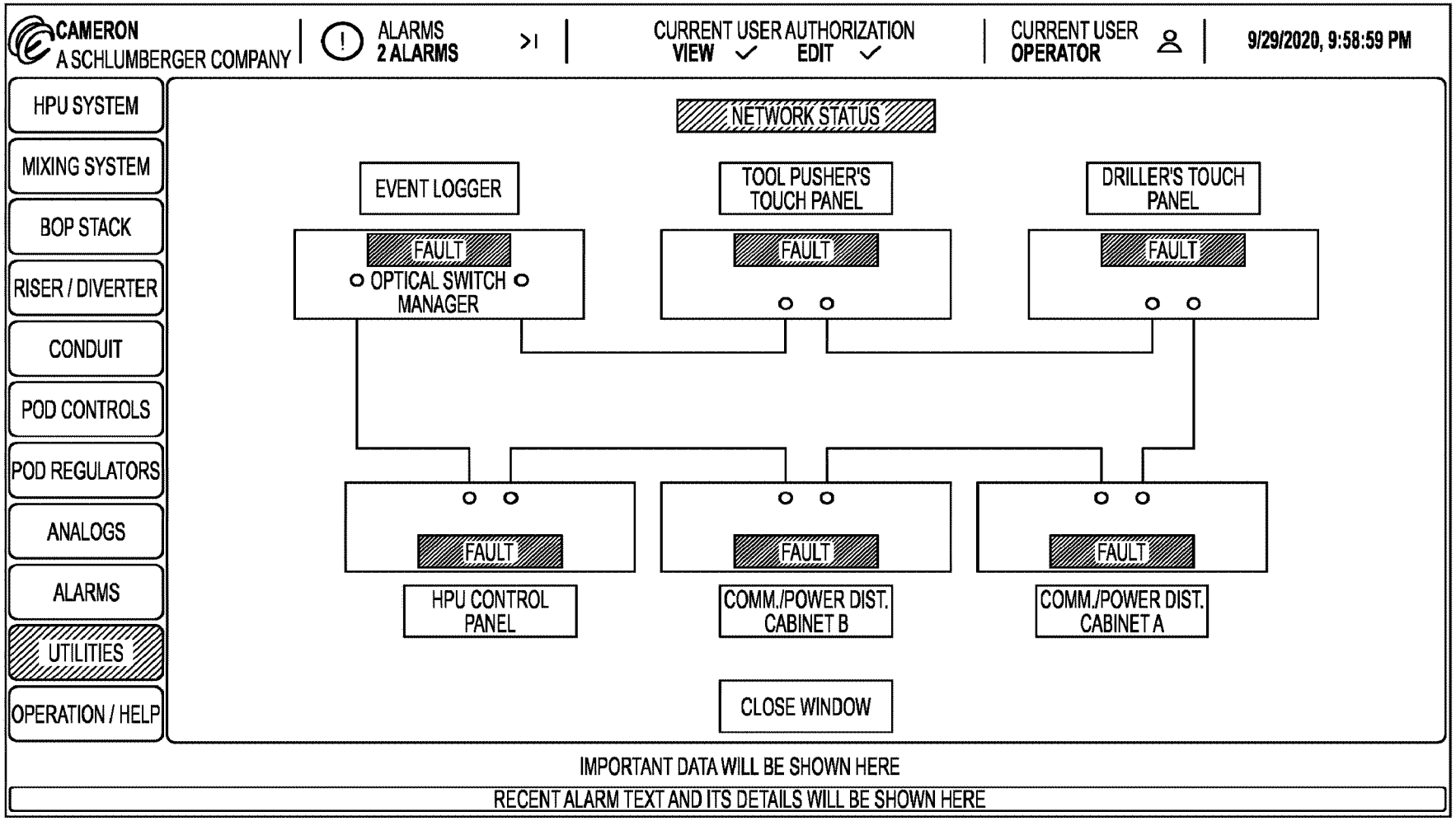
FIG. 14 illustrates a user interface that provides a detailed representation of network status, in accordance with an embodiment of the present disclosure.

In FIG. 13, a user interface 150 may provide an overview of utilities, such as security, login, network status, diagnostics, and the like. In FIG. 14, a user interface 160 may provide a detailed representation of network status, such as whether certain sensors, controllers, or the like are properly coupled to enable control by the user.

The interactive monitoring and control system disclosed herein may provide various user interfaces that enable efficient (e.g., "one-click") navigation to view data related to the system 10 of FIG. 1 and/or to control components of the system 10 of FIG. 1. The interactive monitoring and control system may enable the user to view the information and/or to control the components at the wellsite or remotely from the wellsite (e.g., hundreds of kilometers or more from the wellsite). For example, the user may carry out these steps using a remote computing device to request access to a webpage with the HMI and with the substantially real-time information based on sensor data. The user may also receive alarms in substantially real-time as the event occurs (e.g., with only minor delay due to communication speed and/or processing speed).

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. An interactive monitoring and control system for a mineral extraction system, comprising:

one or more processors configured to:

receive sensor data indicative of properties of components of the mineral extraction system, the components of the mineral extraction system including at least a blowout preventer (BOP); and provide a user interface for display via a display screen, wherein the user interface comprises:

a menu portion of the user interface that is persistent on a side of the user interface, the menu portion comprising a plurality of selectable interface elements including a BOP stack interface element and a gauges interface element; and an active portion of the user interface adjacent the menu portion, wherein the active portion updates in response to receiving an indication of a user selection of a selectable interface element of the plurality of selectable interface elements, wherein:

in response to a selection of the BOP stack interface element, the active portion updates to a BOP stack update, wherein the BOP stack update displays a component representation of the components of the mineral extraction system, wherein a status of the components is overlaid onto the component representation, and wherein one or more selectable inputs are displayed to adjust the components; and in response to a selection of the gauges interface element, the active portion updates to display a gauges update, the gauges update including a gauges section, a graph section, and a table section, wherein:

the gauges section displays a gauge representation of a plurality of gauges displaying the sensor data indicative of the properties of the components of the mineral extraction system;

each gauge of the plurality of gauges is selectable to display an associated trend graph in the graph section of the active portion;

each associated trend graph is interactable to populate an associated table in the table section with one or more measurements of the sensor data at one or more time intervals selected from the associated trend graph; and the table section includes a toolbar for performing calculations on the one or more measurements populated in the associated table.

2. The interactive monitoring and control system of claim 1, wherein the one or more processors are configured to provide the user interface for display via the display screen that is part of a remote computing device in response to receipt of a request from the remote computing device to access a webpage having the user interface.

3. The interactive monitoring and control system of claim 1, wherein any change to the mineral extraction system commanded by a user is tracked and associated with the user.

4. The interactive monitoring and control system of claim 1, wherein the gauges section of the gauges update displays the sensor data in an analog format and a digital format.

5. The interactive monitoring and control system of claim 1, wherein the user interface provides operational assistance information for a user.

6. The interactive monitoring and control system of claim 1, wherein the user interface provides a network representation of network status.

7. The interactive monitoring and control system of claim 1, wherein the user interface enables one-click navigation to view data related to the mineral extraction system.

8. The interactive monitoring and control system of claim 1, wherein the gauge representation includes a dial indicative of current measurements, and wherein the associated trend graph includes a historical trend of past measurements.

9. The interactive monitoring and control system of claim 1, wherein the toolbar performs the calculations after the associated table is populated by a plurality of measurements.

* * * * *